US005687579A

United States Patent [19]

Vaynberg

[11] Patent Number: 5,687,579

[45] Date of Patent: Nov. 18, 1997

[54] DOUBLE CIRCUITED REFRIGERATION SYSTEM WITH CHILLER

[76] Inventor: Mikhail M. Vaynberg, 411 Hazelwood, San Francisco, Calif. 94127

[21] Appl. No.: 304,362

[22] Filed: Sep. 12, 1994

[51] Int. Cl.[6] ..... F25B 7/00; F25B 41/00

[52] U.S. Cl. ..... 62/175; 62/335; 62/513

[58] Field of Search ..... 62/175, 335, 513

[56] References Cited

U.S. PATENT DOCUMENTS

| | | | |
|---|---|---|---|
| 2,968,933 | 1/1961 | Pfeifer et al. | 62/176 |
| 2,984,084 | 5/1961 | Talmey et al. | 62/239 |
| 3,386,260 | 6/1968 | Kirkpatrick | 62/239 |
| 3,572,052 | 3/1971 | Toth | 62/278 |
| 3,733,849 | 5/1973 | Cantagallo et al. | 62/414 |
| 4,402,189 | 9/1983 | Schaeffer | 62/335 X |
| 4,691,527 | 9/1987 | Ikeda | 62/234 |
| 5,170,639 | 12/1992 | Datta | 62/228.3 |
| 5,187,945 | 2/1993 | Dixon | 62/234 |
| 5,417,076 | 5/1995 | Vaynberg . | |
| 5,425,244 | 6/1995 | Vaynberg . | |
| 5,447,038 | 9/1995 | Vaynberg . | |

OTHER PUBLICATIONS

York Transportation Equipment Service and Parts Manual Model TNE 256 NL, p. 9, Figure 3.

York Tranportation Refrigeration and Air Conditioning Equipment Twin–Pak TNE–255 Sales Brochure.

Billy C. Langley, "Heating, Ventilating, Air Conditioning, and Refrigeration", pp. 56–58, Prentice–Hall, Inc. 1990.

Robert Chatenever, "Air Conditioning and Refrigeration for the Professional", pp. 171–174, John Wiley & Sons, Inc. 1988.

Roy J. Dossat, "Principles of Refrigeration", Third Edition, pp. 476–483, Prentice–Hall, Inc. 1991.

Coldwrap Sea Containers Inc., "The Story of Our New Rent–A–Container is a Lot of Cold Air.", Sales Brochure.

"1990 Ashrae Handbook Refrigeration Systems and Applications", American Society of Heating, Refrigerating and Air Conditioning Engineers, Inc., pp. 28.1–30.16.

"Ashrae Handbook 1982 Applications", American Society of Heating, Refrigerating and Air Conditioning Engineers, Inc., pp. 43.1–45.18.

"1986 Ashrae Handbook Refrigeration Systems and Applications", American Society of Heating, Refrigerating and Air Conditioning Engineers, Inc., pp. 28.1–30.18.

Thermo King Sales Brochure for Models SB–III & SB–III Max.

Andrew D. Althouse, Carl H. Turnquist, Alfred F. Bracciano, "Modern Refrigeration and Air Conditioning", The Goodheart–Wilcox Company, Inc. 1992, pp. 75–99.

*Primary Examiner*—William E. Wayner

*Attorney, Agent, or Firm*—Haverstock & Associates

[57] ABSTRACT

A more efficient system for cooling a load to very low temperatures by utilizing a double circuited refrigeration design. The design incorporates an air cooled condenser in a first circuit coupled in parallel with a water cooled condenser. The water cooled condenser is further coupled to a chiller in a second circuit. The chiller operates as an evaporator in the second circuit to cool a liquid that circulates between the chiller and the water cooled condenser. As the cool liquid circulates through the water cooled condenser, it enhances the efficiency of the water cooled condenser. The system operates in a single circuited mode when the difference between the desired load temperature and the ambient temperature is relatively small. The system operates in a double circuited mode the difference in temperatures is relatively large. A controller coupled to the system automatically configures the system to operate in the single or double circuited mode depending on the difference in temperatures between a desired load temperature and an ambient temperature. If the difference is slight, then the controller will automatically configure for single circuited mode. If the difference in temperatures is great however, then the controller will configure the system for double circuited mode.

6 Claims, 1 Drawing Sheet

DOUBLE CIRCUITED REFRIGERATION SYSTEM WITH CHILLER

FIELD OF THE INVENTION

This invention relates to refrigeration systems. More particularly, this invention relates to a double circuited refrigeration system that utilizes a chiller in one circuit to increase the efficiency of a condenser in a second circuit.

BACKGROUND OF THE INVENTION

Typical refrigeration systems utilize a single compressor system. Such systems are commonly used in refrigerated containers for trucks, rail and shipboard transportation of food products. Note that this patent is not limited to the transportation of food products.

Single compressor containers are unequal to certain cooling tasks. For example, once produce is picked it is desirable to immediately reduce its temperature to prevent spoiling. During hot summer months, shippers of produce transport the produce to a cold storage warehouse to bring the produce down to temperature before loading onto a refrigerated container which merely operates to maintain the temperature of the precooled produce are incapable of bringing the produce to adequate temperature quickly enough. The ability of such transportation devices to cool a hot load of produce in a sufficiently short time to prevent spoilage does not exist in commercially-available containers.

Most commercially-available refrigerated containers for transportation are single compressor systems. Generally, single compressor systems are inadequate for cooling a load below about −20° F. Some commercially-available refrigerated containers having single compressor systems can cool a load to about 0° F. Unfortunately, purchasers of refrigerated containers desire a device which can maintain a load at −20° F. and lower at ambient temperatures up to +150° F.

By way of example, consider a single compressor system for cooling a load to −20° F. in an ambient environment of 150° F. The evaporator temperature necessary to maintain the load at a predetermined temperature is at the best 10° F. colder than the load. Here the evaporator is cooled to −30° F. Under these conditions using R12, the evaporator pressure is expected to be approximately 9 psi and using R22, the expected pressure is approximately 20 psi. Similarly, the condenser temperature necessary to discharge heat to the ambient is 10° to 40° warmer than the ambient under the best case conditions; thus, in this example, the condenser is at 160° F. The pressure in the condenser under these conditions is expected to be approximately 278 psi for R12 and 445 psi for R22.

The conditions in the example of the previous paragraph dictate a compression ratio of 278/9≈31 for R12 and 445/20≈22 for R22. Refrigeration compressors are designed and built to operate with a compression ratio no greater than 15. If the pressure ratio exceeds the manufacturer's design criteria the compressor will break. Accordingly, neither example above could be achieved with a conventional single compressor system. Indeed, a commercially available compressor is not available with the capacity to operate in a refrigerated container environment under the above conditions and accordingly, such a system in a refrigerated container would be prohibitively expensive and inefficient. Thus, commercially available single compressor systems are incapable of operating where the difference between the desired product temperature and the actual ambient temperature is very large as in these examples.

Cascade systems are well known. It is well understood in cascade systems that heat from a lower cascade condenser is removed by the evaporator of a high cascade compressor system; and heat from the high cascade system is dissipated into the ambient. The pressure ratio for the cascade system is the product of the pressure ratio for both the low cascade compressor system and the high cascade compressor system. A cascade system for the R22 example described above would also have a pressure ratio of approximately 22 and it could have both the low and high compressor systems operating at the same pressure ratios, i.e., both pressure ratios at approximately 4.7 for each compressor. This pressure ratio is well within an acceptable range of the specifications of commercially available compressors.

Cooling systems require a minimum pressure ratio to operate. If the necessary pressure ratio becomes too small the compressor will fail. As the difference between the product temperature and the ambient temperature is reduced, the pressure ratio for a cooling system is also reduced. When using a cascade cooling system, as the difference between these temperatures becomes smaller, the pressure ratio for both compressor systems will fall below the minimum pressure ratio necessary for operation sooner than a system using a single compressor.

Conventional cascade systems use different refrigerants, one for each compressor in each system. This requires the system designer to uniquely design the low compressor system and the high compressor system. Commonly used refrigerants are 502 and R12. To protect the environment, these refrigerants will be banned after 1995. The refrigerant R22 is far less damaging to the environment than 502 or R12 and as such is not scheduled to be banned until 2020.

In my three copending applications, I disclose three different cooling systems that are automatically configurable to operate in single compressor mode operation or in cascade mode depending upon the desired operating conditions. My three applications which are incorporated herein by reference have the following serial numbers, filing dates and titles: 1) U.S. patent appln. Ser. No. 08/153,173, filed: Nov. 16, 1993, entitled: CASCADE COOLING SYSTEM, now U.S. Pat. No. 5,417,076, 2) U.S. patent appln. Ser. No. 08/153,172, filed: Nov. 16, 1993, THREE TEMPERATURE COOLING SYSTEM USING CASCADE MODE, now U.S. Pat. No. 5,447,038, and 3) U.S. patent appln. Ser. No. 08/153,673, filed: Nov. 16, 1993, entitled: DOUBLE CIRCUITED CASCADE COOLING SYSTEM, now U.S. Pat. No. 5,425,244. Unfortunately, for cascade mode operation, all three of my systems rely upon the transfer of heat using air between the low and high compressor systems. As is well known, heat transfer by air is not very efficient.

Although conventional cascade systems are more efficient than single compressor systems, they are still not as efficient as they could be designed. What is needed is a refrigeration system that avoids the efficiency loss resulting from heat exchanges carried out be air transfer.

SUMMARY OF THE INVENTION

The present invention provides a more efficient means for cooling loads over a wide variety of temperature differentials by utilizing an automatically configurable double circuited refrigeration design. The design incorporates an air cooled condenser in a first circuit coupled in parallel with a water cooled condenser. The water cooled condenser is further coupled to a chiller in a second circuit. The chiller operates as an evaporator in the second circuit to cool a liquid that circulates between the chiller and the water cooled condenser. As the cool liquid circulates through the water cooled condenser, it enhances the efficiency of the water cooled condenser.

The invention operates in a single circuited mode when the difference is small between the ambient and the desired load temperature and in a double circuited mode when the difference in temperatures is large. A controller coupled to the system automatically configures the system to operate in the single or double circuited mode depending on the difference in temperatures between a desired load temperature and an ambient temperature. If the difference is slight, then the controller will automatically configure for single circuited mode. If the difference in temperatures is great however, then the controller will configure the system for double circuited mode.

DETAILED DESCRIPTION OF THE PREFERRED EMBODIMENT

Figure 1:
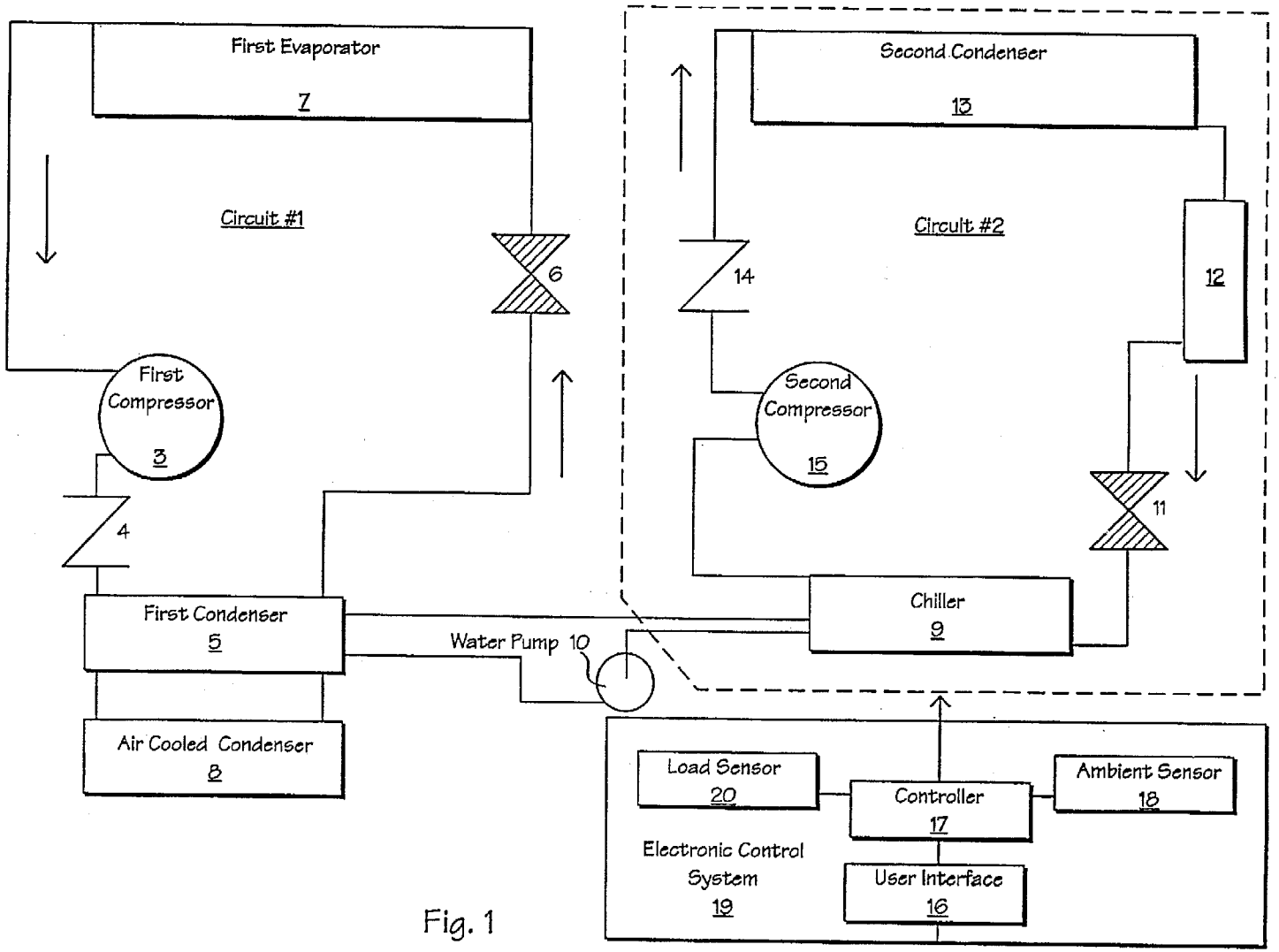
FIG. 1 shows a block diagram of the preferred embodiment of the present invention.

The refrigeration system of the present system is configured to operate in either a single or double circuited mode. The single circuited mode is utilized when only moderately low temperatures are required and in double circuited mode when very low temperatures are required. Preferably, an electronic control system 19 configures the present system based on a desired load temperature as compared with an ambient temperature.

In the event the refrigeration system is operating in single circuited mode, circuit 2 is disabled allowing only circuit 1 to operate. A first compressor 3 compresses a hot gas through check valve 4 where it is then applied to a first condenser 5. The first condenser 5 operates as a receiver for the air cooled condenser 8 alone when in single circuited mode. (The first condenser 5 operates as a receiver both for itself and the air cooled condenser 8 when the system is operating in double circuited mode.) The hot gas is then condensed to a liquid in the air cooled condenser 8 before passing through a thermal expansion valve 6 and into a first evaporator 7 where it evaporates into a hot gas. The system then cycles as the hot gas is compressed in the first compressor 3.

If the desired temperature of a load is too low in comparison to the ambient temperature for the system to accommodate utilizing the single circuited mode, the automatic controller 17 will automatically enable circuit 2. The system will then operate in the double circuited mode.

Instead of the hot gas cooling in the air cooled condenser 8 alone, it is also cooled in the first condenser 5. Cool liquid circulated between the first condenser 5 and a chiller 9 via a water pump 10, operate to more effectively condense and therefore cool the hot gas. In the preferred embodiment the liquid is water. The chiller operates to keep the circulating liquid cool by essentially acting as an evaporator for the second circuit. A second refrigerant is cooled and condensed in a second condenser 13 before it passes through a filter/dryer 12 and a thermal expansion valve 11. The condensed refrigerant then evaporates to a hot gas in the chiller 9. As the condensed refrigerant evaporates in the chiller 9, it draws heat from the circulating liquid. The hot gas is then compressed in a second compressor 15 before it passes through a check valve 14 and is allowed to recirculate though the second circuit.

In the preferred embodiment, circuit 2 is coupled to the electronic control system 19. The electronic control system 19 incorporates a controller 17 coupled to a load sensor 20 for determining the temperature of a load. The controller 17 is further coupled to an ambient temperature sensor 18 for determining the ambient temperature outside a load container. The controller 17 is further coupled to a user interface 16 which allows a user to communicate a desired load temperature to the controller 17.

In operation, the user enters the desired load temperature into the automatic controller 17 through the user interface 16. Using sensor data from the load sensor 20 and the ambient sensor 18, the controller 17 calculates a difference between the two sensor values. If the difference is greater than a preset threshold, the system is configured for double circuited mode. If the difference does not exceed the threshold, the system will operate in single circuited mode.

What is claimed is:

1. A double circuited refrigeration system for cooling a product load to a predetermined temperature comprising:

a. a first circuit having a first compressor coupled to provide compressed hot gas to a liquid cooled condenser which in turn is coupled to provide liquid to an evaporator which in turn is coupled to provide hot gas to the first compressor, the first circuit further having a first air cooled condenser coupled in parallel with the liquid cooled condenser;

b. a second circuit having a second compressor coupled to provide compressed hot gas to a second air cooled condenser which in turn is coupled to provide liquid to a chiller which in turn is coupled to provide hot gas to the second compressor;

c. a water pump is coupled to circulate water between the first condenser and the chiller; and d. means for selectively operating the first circuit or both circuits simultaneously.

2. The refrigeration system according to claim 1 further comprising an automatic controller coupled to the second circuit for automatically configuring the system.

3. The refrigeration system according to claim 2 further comprising:

a. means for entering a desired temperature to the controller coupled to the automatic controller;

b. a first temperature sensor coupled to provide temperature data to the controller for sensing an ambient temperature; and c. a second temperature sensor coupled to provide temperature data to the controller for sensing a load temperature.

4. A double circuited refrigeration system for cooling a product load to a predetermined temperature comprising:

a. a first compressor for compressing a first hot gas into a first supply of compressed hot gas;

b. a first condenser coupled to the first compressor for condensing the hot gas to a cooled liquid;

c. an evaporator coupled between the first condenser and the first compressor for evaporating the liquid refrigerant, the first condenser further coupled to an air cooled condenser;

d. a chiller coupled to the first condenser for cooling a liquid circulating between the chiller and the first condenser, the chiller also acting as an evaporator for evaporating a second liquid refrigerant as the liquid cools;

e. a water pump coupled between the chiller and the first condenser for circulating the liquid;

f. a second condenser coupled to provide the chiller with the second liquid refrigerant; and g. a second compressor coupled between the second condenser and the chiller to provide the second condenser with a second supply of compressed hot gas.

5. The refrigeration system according to claim 4 further comprising an automatic controller for automatically configuring the system.

6. The refrigeration system according to claim 5 further comprising:

a. means for entering a desired temperature to the controller coupled to the automatic controller;

b. a first temperature sensor coupled to provide temperature data to the controller for sensing an ambient temperature; and c. a second temperature sensor coupled to provide temperature data to the controller for sensing a load temperature.

* * * * *